US005160023A

United States Patent [19]

Adams et al.

[11] Patent Number: 5,160,023

[45] Date of Patent: Nov. 3, 1992

[54] TWO CARTONS JOINED AS A SINGLE UNIT SEPARABLE INTO TWO SINGLE CARTONS

[75] Inventors: John M. Adams, Mechanicsville; Christopher N. Chance, Richmond; James A. DeBlasio, Midlothian; Donald H. Evers, Richmond; William C. Harris, Jr., Midlothian; Michael A. Kirby, Sr., Trevilians; Reginald W. Newsome; Xuan M. Pham, both of Richmond; Robert E. Talley, Chester, all of Va.

[73] Assignee: Philip Morris Incorporated, New York, N.Y.

[21] Appl. No.: 810,677

[22] Filed: Dec. 19, 1991

Related U.S. Application Data

[63] Continuation-in-part of Ser. No. 774,529, Oct. 8, 1991.

[51] Int. Cl.[5] ..... B65D 85/10; B65B 35/30; B65B 11/58

[52] U.S. Cl. ..... 206/256; 53/448; 53/449; 53/462; 206/273; 206/813; 206/459.5; 229/120.011

[58] Field of Search ..... 53/448, 449, 462, 443, 53/466; 206/256, 273, 264, 813; 129/120.011, 120.01, 120.09

[56] References Cited

U.S. PATENT DOCUMENTS

| | | | |
|---|---|---|---|
| 1,875,197 | 8/1932 | Molins | 206/256 |
| 2,109,583 | 3/1938 | Bennett | 206/813 |
| 2,565,509 | 8/1951 | Marcin | 206/813 |
| 2,605,897 | 8/1952 | Rundle | 206/264 |
| 2,973,130 | 2/1961 | Cottrill | 229/51 |
| 3,113,673 | 12/1963 | Stein | 206/65 |
| 3,144,190 | 8/1964 | Holt et al. | 229/27 |
| 3,447,733 | 6/1969 | Smith et al. | 206/491 |
| 3,503,568 | 3/1970 | Galley | 242/74 |
| 3,759,378 | 9/1973 | Werth | 206/429 |
| 3,809,227 | 5/1974 | Begemann | 206/264 |
| 4,424,658 | 1/1984 | Focke | 53/398 |
| 4,441,611 | 4/1984 | Sommariva | 206/431 |
| 4,485,926 | 12/1984 | Lenzmeier | 206/602 |
| 4,631,900 | 12/1986 | Mattei et al. | 53/448 |
| 4,669,611 | 6/1987 | Flaherty | 206/442 |
| 4,738,359 | 4/1988 | Phillips, Jr. | 206/256 |
| 4,928,817 | 5/1990 | Focke | 206/256 |
| 4,932,534 | 6/1990 | Focke et al. | 206/602 |

FOREIGN PATENT DOCUMENTS 358560 10/1931 United Kingdom .

*Primary Examiner*—William I. Price

*Attorney, Agent, or Firm*—Jeffrey H. Ingerman; Karen G. Horowitz

[57] ABSTRACT

A cigarette carton adapted to contain two rows of five cigarette packs per row. The carton is formed from two substantially identical cartons which are each adapted to contain one row of five cigarette packs. The two cartons are connected along their front walls, which face one another, with a joining strip which is placed over or between the tops of the front walls. The cartons are also connected along their bottom walls with a label. These connections keep the two cartons securely connected when in the ten-pack configuration so that they can be processed through standard machinery for processing ten-pack cartons, such as tax-stamping machinery. The cartons can readily be separated by a consumer for the sale of an individual five-pack carton.

25 Claims, 5 Drawing Sheets

FIG. 6
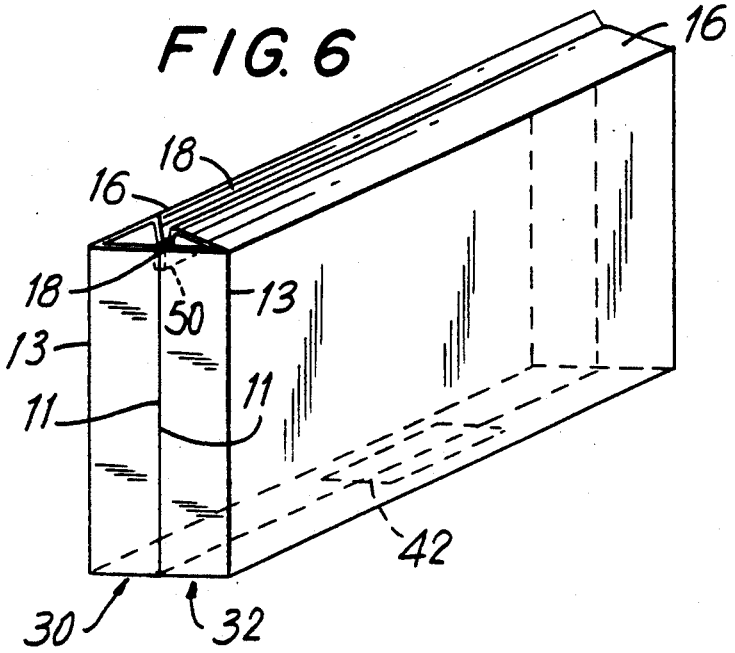
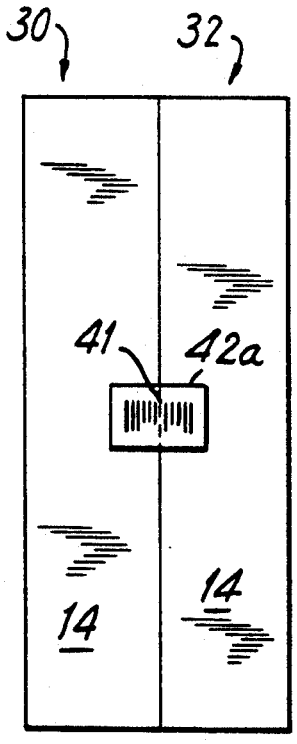
FIG. 7

TWO CARTONS JOINED AS A SINGLE UNIT SEPARABLE INTO TWO SINGLE CARTONS

CROSS REFERENCE TO RELATED APPLICATION

This invention is a continuation-in-part of copending, commonly assigned United States patent application Serial No. 07/774,529 filed Oct. 8, 1991, which is hereby incorporated by reference in its entirety.

BACKGROUND OF THE INVENTION

This invention relates to cigarette cartons, and particularly to the connection of two separate cigarette cartons to form a dual carton.

Cigarette packs (which usually contain twenty cigarettes) are generally rectangular in shape, having front and back long walls and two short side walls. Cigarette cartons typically contain two rows of five cigarette packs per row (each row arranged so that the front long walls of the packs are in the same plane and the back long walls are in a parallel plane spaced from the front long walls), and are generally known in the art as ten-pack cartons. Such cigarette cartons are generally filled with cigarette packs by the manufacturer, temporarily closed (e.g., by folding the top flap of the carton over the box and releasably securing the flap in the closed position), and shipped to various distributors. The distributors generally open the cartons, after they are received, to apply the tax stamp that may be required by the jurisdiction in which they operate to the ends of the individual cigarette packs inside the cartons. Such procedures are commonly automated to reduce time, cost, and labor through the use of specially designed machines for applying tax stamps. Tax-stamping machines have been developed to open the cartons, apply the stamps, and finally seal the cartons for distribution. Such machines are generally commercially available, and are well known in the art. These machines have been specifically developed for standard ten-pack cigarette cartons. A typical tax-stamping machine is model FUSON manufactured by Meyercord of 365 East North Avenue, Carol Stream, Ill. 60187.

Single row cigarette cartons which are dimensioned to contain one row of five cigarette packs (each pack usually containing twenty cigarettes, the packs arranged so that the front long walls of the packs are in the same plane and the back long walls are in a parallel plane spaced from the front long walls), i.e., five-pack cartons, are also known in the art. However, although machinery exists for manufacturing such cartons, machinery does not exist for stamping the cigarette packs contained in such cartons. Consequently, such cartons are usually put into scored, glued, and collapsed cartons to be hand-stamped (as is done currently), or would have to be secured together in pairs to be run through the existent tax-stamping equipment in which packs in double row cartons are stamped. To assure that the tax stamp is properly registered, the means for securing the cartons must be strong enough to keep the cartons together such that they are not sheared apart by the vertical rollers of the tax-stamping machines which roll along the vertical walls of the cartons to transfer the cartons between the various stages of the process.

If two narrow cartons are to be secured together, the means for securement must allow for later separation of the cartons, if desired, by the retailer or consumer. For marketing purposes, once separated, the two cartons should have little or no trace of the means for securement which would disfigure the outward appearance of the cartons.

SUMMARY OF THE INVENTION

It is therefore an object of this invention to provide for the capability of manufacturing and distributing cartons narrower than those processed by existent tax-stamping machinery common to distributors, without requiring customized tax-stamping machinery or hand stamping of the packs.

It is a further object of this invention to provide a means for securing two narrow cartons together to form a dual carton such that the two cartons do not move relative to one another while being transferred throughout the tax-stamping machinery designed to process cigarette cartons having the dimensions of the dual carton.

It is still another object of this invention to provide a means for making a clean separation between the two narrow cartons if desired for sale as individual cartons instead of as a dual carton composed of two narrow cartons.

These and other objects of the invention are accomplished in accordance with the principles of the invention by providing carrier means bearing adhesive to securely connect two narrow cartons, such as five-pack cartons, together to have the final combined dimensions of a dual carton, such as a ten-pack carton, which may be passed through commercially available tax-stamping machinery. Such carrier means is designed to allow for the separation of the two narrow cartons, if desired, for individual sale, without leaving unsightly residue which may negatively effect marketability.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which:

FIG. 6 is an isometric view of two completely formed five-pack cartons joined to form a ten-pack carton with the top flap of each five-pack carton tucked into its respective carton;

FIG. 7 is a bottom plan view of two five-pack cartons connected, in accordance with this invention, with carrier means bearing indicia for price coding;

DETAILED DESCRIPTION OF THE INVENTION

Figure 1:
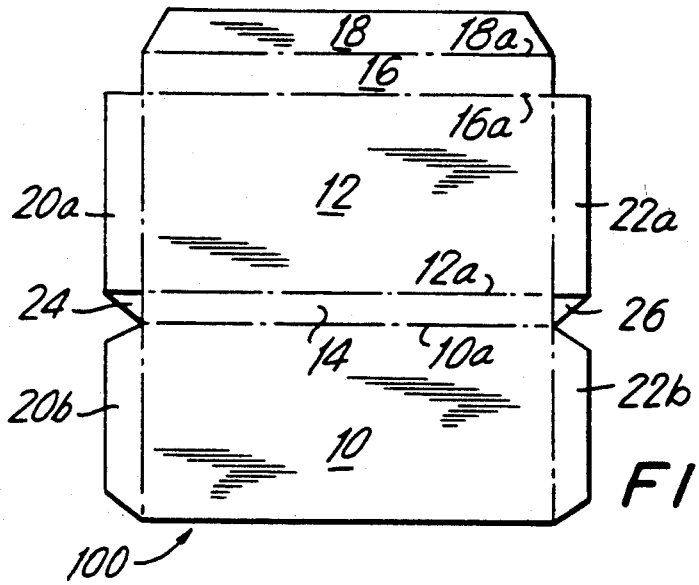
FIG. 1 is a plan view of an illustrative carton blank for a five-pack carton in accordance with this invention.

As shown in FIG 1, blank 100, used for forming a carton adapted to hold one row of five cigarette packs, i.e., a five-pack, has a plurality of fold lines represented by broken lines. Blank 100 is preferably formed from a substantially rigid material such as paperboard. Each relatively large panel 10 and 12 of blank 100 is substantially five times the width of a long wall of a cigarette pack to be enclosed therein. As used herein, a standard cigarette pack is defined as any pack commonly used for holding a predetermined number of cigarettes, and generally having front and back long walls connected by two short side walls (each pack usually containing twenty cigarettes). When blank 100 is folded along respective fold lines 10*a* and 12*a*, panel 10 will become the front wall of the carton and panel 12 will become the rear wall of the carton. Joining panels 10 and 12 is a bottom panel 14, which will form the bottom wall of the carton when the blank is folded into a carton. Panel 16, which is substantially the same dimension as bottom panel 14, extends from rear panel 12. After walls 10 and 12 are assembled, panel 16 is folded along fold line 16*a* over the top of the carton to extend between walls 10 and 12 of the carton. Extension panel 18 joins panel 16 along a fold line 18*a*. Additional fold lines, similar to fold lines 10*a*, 12*a*, 16*a* and 18*a*, located on blank 100, are shown as broken lines, but are not individually labeled.

Panels 16 and 18 together form a top and tuck-in flap 17. When the carton is formed and is ready for consumer purchase, extension panel 18 preferably lies substantially parallel to front wall 10, preferably inside the carton, and panel 16 is folded over the top of the carton towards front wall 10. Side panels 20*a* and 20*b* are folded one over the other to form a side wall 20 of the carton. Side panels 22*a* and 22*b* are folded in a similar fashion to form side wall 22. The "a" panel is preferably folded over the "b" panel. Tabs 24 and 26 are preferably folded perpendicular to panel 14 before the side panels are folded and will eventually lie substantially parallel to their respective side walls. The distance between panels 10 and 12 of the completed carton is substantially the same as the distance between the front and back long walls of a cigarette pack to be enclosed therein.

Figure 2:
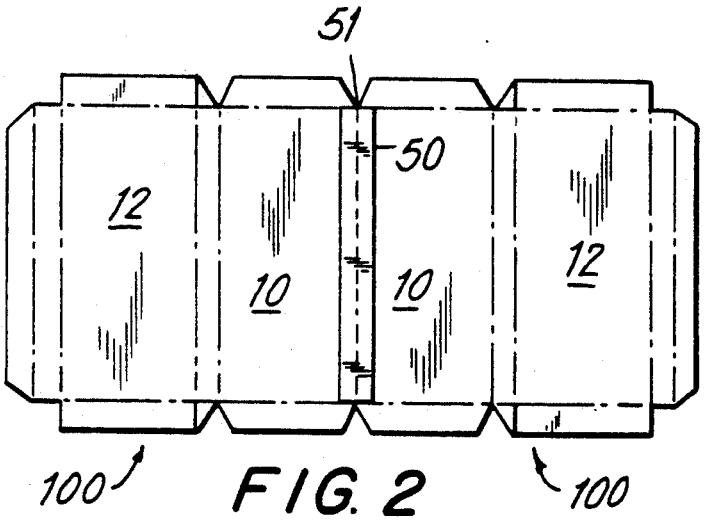
FIG. 2 is a plan view of two blanks connected together with a joining strip in accordance with this invention.

Two identical blanks 100 are joined together along the free ends of panels 10 with a joining strip 50, as seen in FIG. 2. Joining strip 50 is preferably made of a material such as paper, mylar, or plastic which is adhered to blanks 100 with either permanent adhesive (any known permanent adhesive) or releasable pressure-sensitive adhesive. Releasable pressure-sensitive adhesive is herein defined as any known adhesive which, preferably, is clear, has no taste or odor, and does not cause fiber pull of the carrier means or leave a tacky residue once the surfaces joined by the adhesive are separated (e.g., adhesive which provides a strong bond between surfaces, but once the surfaces are pulled apart, the bond of the adhesive is broken and the adhesive is no longer tacky). Joining strip 50 optionally has a weakened line, such as perforated line 51, positioned over the adjoining abutting edges of panels 10.

Figure 3:
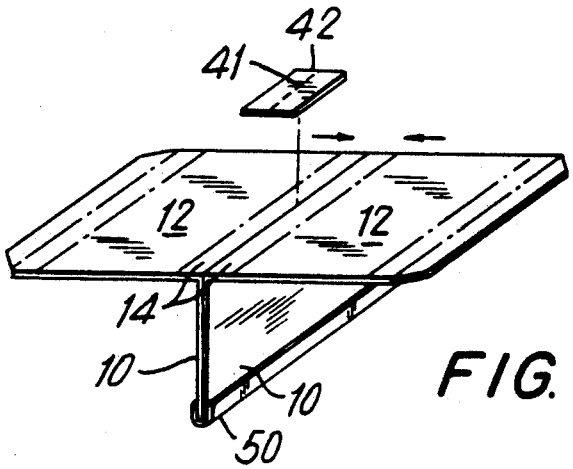
FIG. 3 is an isometric view of two five-pack carton blanks joined with a joining strip and partially folded in preparation for further connection to each other to form a ten-pack carton in accordance with this invention.

After panels 10 are joined, blanks 100 are folded along joining strip 50 so that panels 10 lie on top of and adjacent one another. The blanks are further folded along fold line 10*a* so that panels 14 are adjacent one another and lie in the same plane, as seen in FIG. 3. It will be appreciated that panels 20*a*, 20*b*, 22*a*, 22*b*, 24, and 26 have been omitted from the drawing only for the sake of clarity, and are not intended to be excluded from the invention as depicted. Carrier means bearing adhesive, hereinafter referred to as label 42, is positioned across panels 14 to further secure the two blanks together. The carrier means may be any carrier means such as paper, mylar or plastic and may bear any known adhesive, either permanent or releasable (such as defined above). Label 42 may have a weakened line such as perforated line 41, positioned over the adjacent edges of panels 14, substantially between the two blanks.

Sticker 42 may optionally bear Universal Product Code (U.P.C.) indicia or other pricing indicia (e.g., pricing bar code), such as seen on sticker 42*a*, in FIG. 7. Sticker 42*a* is placed along the bottom walls 14 of cartons 30, 32, formed from the two blanks 100, the lines of the pricing bar code being positioned substantially parallel to the adjacent edges of the walls across which sticker 42*a* is placed. Optional frangible means 41 may be included on sticker 42*a*, substantially parallel to the lines of the bar code. Similar pricing indicia may be located on front walls 10 of the cartons. Such indicia either may be printed directly on the walls or may be printed on labels or stickers positioned on the walls. The exterior, readily visible indicia printed on sticker 42*a* are preferably coded for sale of the combined ten-pack carton and are rendered unreadable by automatic scanning equipment upon tearing the sticker 42 to separate the two five-pack cartons, such as described in copending, commonly assigned United States patent application Ser. No. 07/792,617 (PM-1589), filed Nov. 15, 1991, which is hereby incorporated by reference in its entirety. The interior, not readily visible indicia are preferably coded for sale of the individual five-pack cartons.

Figure 4:
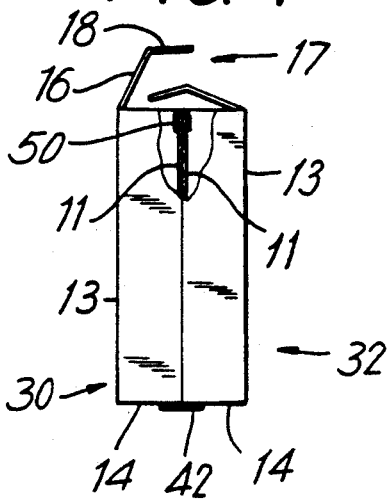
FIG. 4 is a side and partial sectional view of two completely formed five-pack cartons connected to each other to form a ten-pack carton.
Figure 5:
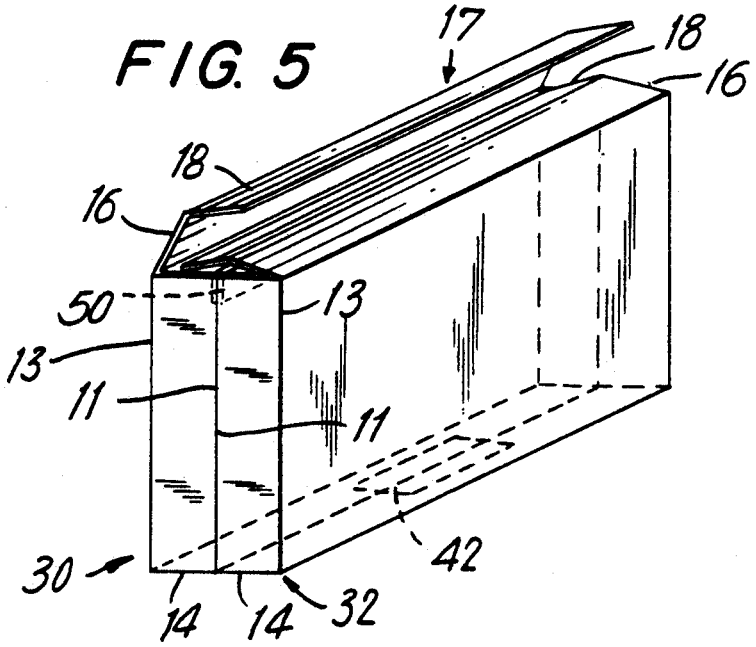
FIG. 5 is an isometric view of two completely formed five-pack cartons joined to form a ten-pack carton with the top flap of each five-pack carton lapped over the tops of the two cartons.

The completed cartons 30, 32, formed from blanks 100, are shown in FIGS. 4–6, already connected with both joining strip 50 and label 42. Front walls 10, positioned in the interior portion of the dual carton formed by cartons 30, 32, are not readily visible and are henceforward referred to as interior walls 11. Rear walls 12 are readily visible and form the exterior walls 13 of the dual carton. Since the "a" panels of blank 100 are preferably folded over the "b" panels (panels 20*a*, 22*a*, 20*b*, and 22*b* shown in FIG. 1), the free edge of each of the "a" panels faces inwardly, i.e., the free edges lie adjacent interior walls 11 when cartons 30, 32 are joined. In this position, the free edges of the "a" panels are relatively safe from being accidentally lifted from their place adjacent the "b" panels, since the free edges are not easily accessible.

After the cartons are completed and the cigarettes are placed within the cartons, flaps 17 are lapped over one another, as seen in FIGS. 4 and 5, in preparation to be shipped to a distributor and later opened for tax-stamping. Flaps 17 are releasably secured to each other so that the dual carton does not open accidentally. The flaps are plowed open by tax-stamping machinery and the cigarette packages inside the cartons are subsequently stamped. The cigarette packs which are placed within cartons 30, 32 generally have a front wall and a back wall and are preferably arranged such that the front walls of the packs face interior walls 11 of the two cartons.

After tax-stamping, flaps 17 of cartons 30, 32 are preferably tucked into their respective cartons such that extension panel 18 is substantially parallel to interior walls 11, as seen in FIG. 6. Panels 16 lie across the tops of the cartons to cover the cigarette packs inside. Flaps 17 may, alternatively, be lapped as shown in FIGS. 4 and 5. Cartons 30, 32 are now ready for sale to consumers.

Figure 8:
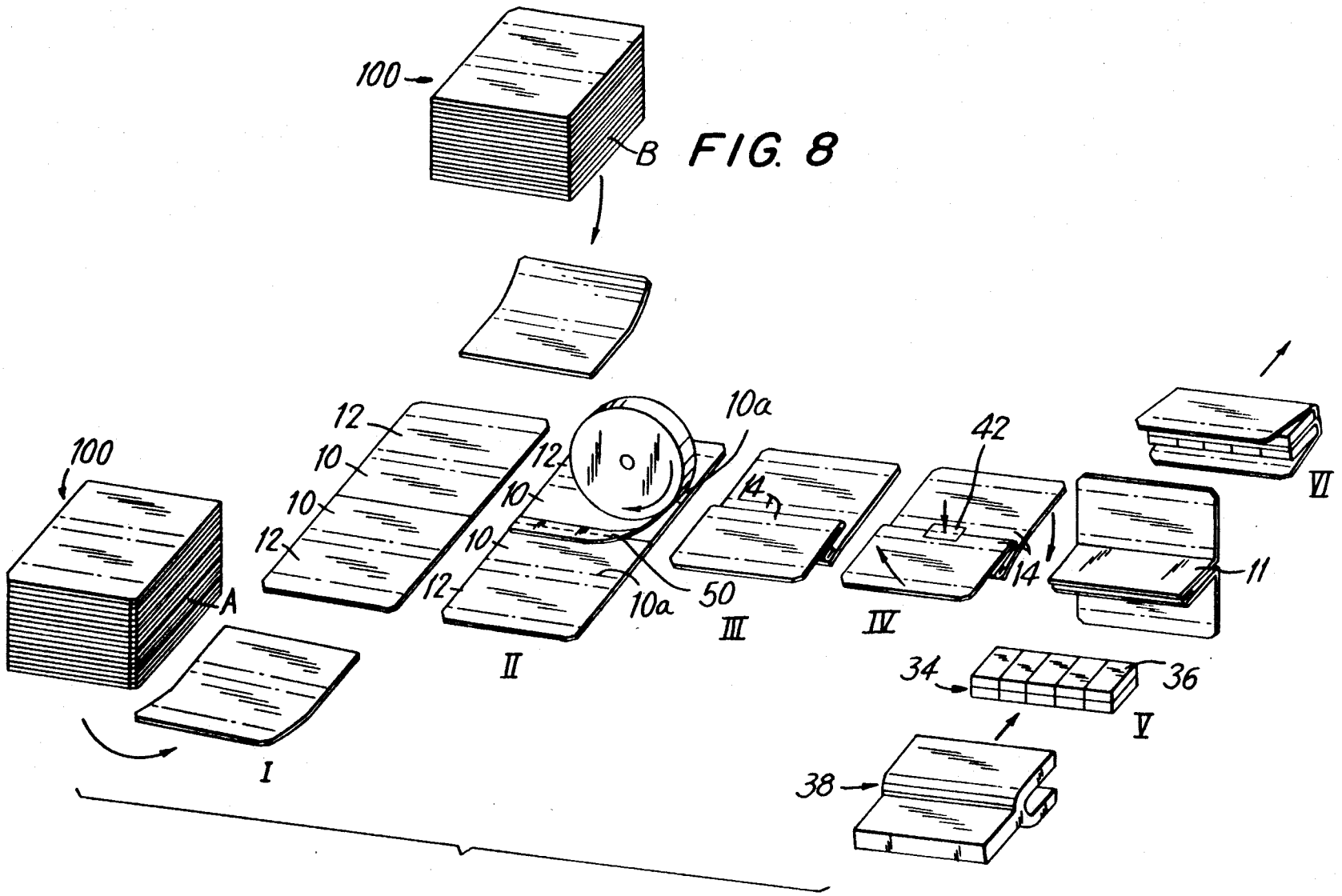
FIG. 8 is a schematic representation of steps involved in forming a ten-pack carton from two five-pack carton blanks in accordance with this invention, in which a joining strip is positioned on the outer surfaces of the blanks.
Figure 9:
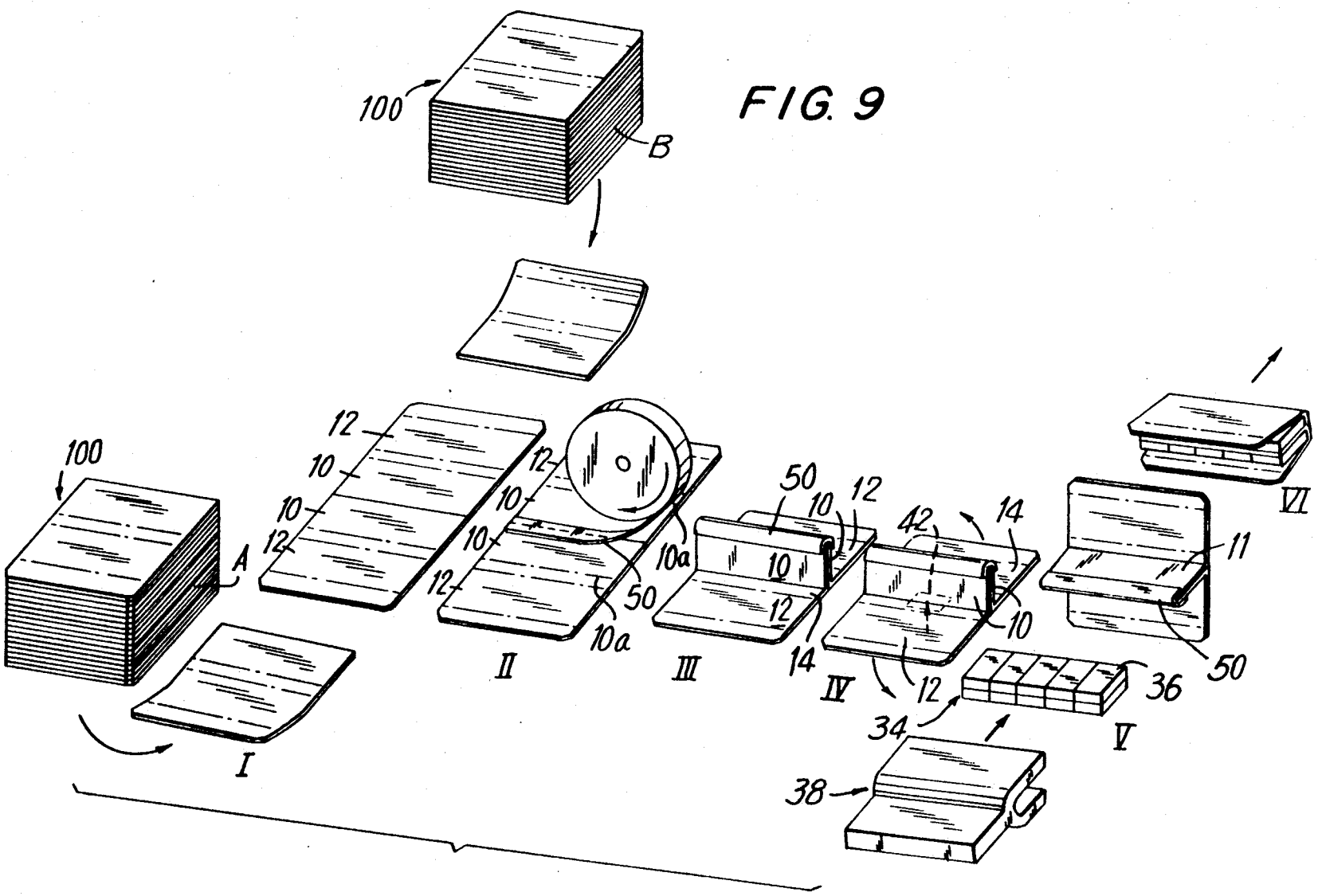
FIG. 9 is a schematic representation of steps involved in forming a ten-pack carton from two five-pack carton blanks in accordance with this invention, similar to the steps shown in FIG. 8, but in which a joining strip is positioned on the inner surfaces of the blanks.

The preferred method for constructing the dual carton formed from cartons 30, 32 is illustrated, but not limited to those shown, in FIG. 8 or 9. Two stacks A, B of blanks 100 are positioned near one another in preparation for forming a dual carton. Each blank has an outer surface which preferably bears printing, and an inner surface which faces the cigarette packs placed within the cartons formed from blanks 100. The outer surface of panels 10 may optionally bear pricing indicia, such as U.P.C. indicia. The blanks of FIG. 8 are positioned with their outer surfaces facing upwards, and the blanks of FIG. 9 are positioned with their inner surfaces facing upwards. As seen in step I of both FIGURES, a single blank 100 is drawn from each stack. The blanks which are drawn are positioned with their front panels 10 adjacent one another, with the top edges of the panels aligned and abutting one another. In step II, joining strip 50 may either be placed on the outer surface of front panels 10, as shown in FIG. 8, or on the inner surface of the panels as shown in FIG. 9. Joining strip 50 preferably is placed substantially parallel to the top edges of front panels 10, and preferably extends along most of the width of front panels 10 to join blanks 100. Each blank 100 is folded along joining strip 50 and along fold line 10*a* so that bottom walls 14 are adjacent and coplanar, as seen in step III of FIGS. 8 and 9. This step results in strip 50 being positioned between the outer surfaces of interior walls 11, according to the method of FIG. 8, or positioned over interior walls 11 on the inner surfaces of the walls, according to the method of FIG. 9. Next, label 42, which optionally bears pricing indicia such as U.P.C. indicia, is placed across the outer surfaces of walls 14, in step IV of both FIGURES, to further join blanks 100. The two blanks are now rotated 90° and, as seen in step V of both FIGURES, cigarette bundle 34, composed of two rows of five cigarette packs 36 per row, are positioned by cigarette pack pushing equipment 38 into the nearly completed dual carton. Once the cigarette packs are in place, the remaining panels of the blanks may be folded to complete the two cartons, as seen in step VI of both FIGURES. It will be appreciated that panels 20*a*, 20*b*, 22*a*, 22*b*, 24, and 26 have been omitted from the drawings only for the sake of clarity, and are not intended to be excluded from the blanks used in the steps depicted.

Although joining strip 50 is shown as a single strip, joining strip 50 may be a strip formed of a number of unconnected shorter strips aligned to form a single row across panels 10.

Although sticker 42 is shown placed across bottom walls 14, sticker 42, or additional stickers similar to sticker 42, preferably without pricing indicia, may be placed across side walls 20 or 22 or both. Additionally, a transparent band of material, such as is common in the art, may be wrapped around the cartons to further secure them together.

It will be appreciated that sticker 42 may or may not bear U.P.C. or other pricing indicia (which preferably bear coding for sale of the dual carton). If such indicia are included, the sticker bearing such indicia may be used in combination with any or all of the disclosed stickers. Such indicia are situated such that the coding for ten-pack sale is rendered unreadable by automatic scanning equipment upon separation of cartons 30, 32. Furthermore, such indicia may be located on a sticker placed across any pair of adjacent coplanar walls as desired. Preferably only one sticker bearing pricing indicia is used.

Although flaps 17, designed to be tucked into cartons 30, 32, are shown, it will be appreciated that any appropriate flap may be used, such as a flap with portion 16 without extension 18, intended to be lapped over the top of the carton, but not tucked partially inside the carton.

Although extension panel 18 is described as tucked inside the carton, extension panel 18 may alternatively be secured to the outside of the carton.

Although cartons 30, 32 are described as each dimensioned to hold one row of five cigarette packs, they may be lengthened or shortened to hold more or fewer than five packs. Furthermore, it will be appreciated that these concepts may be applied to the connection of cartons of other configurations for which distributors commonly have tax-stamping machinery.

It will be appreciated that references to cigarette cartons and cigarette packs are not limited to only rectangular cartons and packs, but are intended to include all configurations which are available to consumers. Cigarette cartons include cartons with windows, cartons with rounded edges, and other configurations which are designed to be passed through tax-stamping equipment. Cigarette packs include such packs as oval packs, packs with rounded edges, and other non-rectangular shapes.

It will be appreciated that references to tax-stamping machinery are intended to include any existing equipment which is readily available to distributors, and modified versions.

It will be understood that the foregoing is merely illustrative of the principles of the invention, and that various modifications can be made by those skilled in the art without departing from the scope and spirit of the invention. The present embodiments are described for the purpose of illustration rather than limitation, and the present invention is limited only by the claims which follow.

What is claimed is:

1. A dual cigarette carton for packaging a first number of cigarette packs and of dimensions compatible with commercially available tax-stamping machinery used in the automated processing of cigarette cartons, each said cigarette pack having a pair of opposed long walls and a pair of opposed short walls, said dual cigarette carton comprising:

first and second cartons each having four substantially vertical walls, an exterior top wall, and an exterior bottom wall; said four vertical walls including an interior front wall, an exterior rear wall substantially parallel and spaced from said interior front wall, and first and second exterior side walls connecting juxtaposed vertical edges of said interior front wall and said exterior rear wall; wherein:

said exterior rear wall has a first extension along the top edge thereof, said first extension being folded perpendicular to said exterior rear wall and extending towards said interior front wall, thereby forming said exterior top wall;

the widths of said interior front wall and said exterior rear wall are at least as wide as a second number of times the width of the long wall of said cigarette pack;

the widths of said exterior side walls are at least as wide as a third number of times the width of the short wall of said cigarette pack;

a fourth number of cigarette packs, equal to the product of said second number of times the width of the long wall of said cigarette pack and said third number of times the width of the short wall of said cigarette pack, can be positioned inside said first carton with said short walls parallel said side walls; and said first and second cartons are positioned adjacent one another with said interior front wall of said first carton coextensive with said interior front wall of said second carton such that the borders of said interior front walls are aligned; said dual cigarette carton further comprising:

a joining strip placed along the top edges of said coextensive interior front walls of said first and second cartons to join said interior front walls and, consequently, said first and second cartons; and at least one substantially flat carrier means having a first side and a second side, and an adhesive borne on one side of said carrier means, said carrier means bearing said adhesive being positioned across at least one pair of adjacent, coplanar, exterior walls of said first and second cartons with said adhesive in operative contact with said last mentioned exterior walls to securely yet releasably connect said cartons in position adjacent one another such that the borders of the interior front walls are aligned; wherein:

said dual cigarette carton is dimensioned to contain twice the fourth number of cigarette packs, which is equal to said first number of cigarette packs.

2. The dual cigarette carton of claim 1 wherein said at least one pair of adjacent, coplanar exterior walls of said first and second cartons across which said carrier means is placed are said bottom walls of said first and second cartons.

3. The dual cigarette carton of claim 1 wherein said joining strip has a line of weakness substantially parallel to said interior front walls and positioned above the edges of said interior front walls.

4. The dual cigarette carton of claim 3 wherein said line of weakness is constituted by a line of perforations.

5. The dual cigarette carton of claim 1 wherein said adhesive borne on said carrier means is a releasable, pressure-sensitive adhesive selected to facilitate removal of said carrier means to separate said cartons for individual sale of said cartons.

6. The dual cigarette carton of claim 1 wherein said carrier means bears indicia encoded for automatic pricing of the dual cigarette carton, and each said interior front wall of said cartons bears indicia encoded for automatic pricing of an individual carton.

7. The dual cigarette carton of claim 6 wherein said indicia borne on said carrier means are bar code lines printed substantially parallel to the adjacent edges of the walls across which said carrier means is positioned such that said indicia are rendered unreadable by automatic equipment when said carrier means is torn upon separating said cartons for sale of the individual cartons.

8. The dual cigarette carton of claim 7 wherein said carrier means has a line of weakness positioned above and substantially parallel to the adjacent abutting edges of the walls across which the carrier means is positioned.

9. The dual cigarette carton of claim 8 wherein said line of weakness is constituted by a line of perforations.

10. The dual cigarette carton of claim 1 wherein each of said first and second cartons further includes a second extension along the end of said first extension, said second extension being folded to be substantially parallel said interior front wall when said extension is folded across the top of said carton.

11. A method of packaging standard cigarette packs for tax-stamping and later sale in two groups, said method comprising the steps of:

(i) providing two stacks of a plurality of identical blanks for cigarette cartons; wherein each said blank has an outer surface and an inner surface, a plurality of substantially horizontal fold lines, and a plurality of substantially vertical fold lines; said substantially horizontal fold lines dividing said blank, consecutively, into a front panel, a bottom panel, a rear panel, and a top panel; and said substantially vertical fold lines dividing the sides of said blank into a first side panel and a second side panel;

(ii) selecting one said blank from each said stack and aligning the front panels of said blanks so that the free horizontal edges of the front panels of said blanks are adjacent one another and said blanks lie in substantially the same plane;

(iii) positioning a joining strip above and across said adjacent free horizontal edges of said front panels to connect said blanks;

(iv) folding said blanks along said joining strip and along one of said horizontal fold lines such that said front panels are adjacent to and coextensive with each other and are perpendicular to the remaining panels formed by said substantially horizontal fold lines of said blanks, and said bottom panels are adjacent one another and lie in the same plane;

(v) placing a label bearing adhesive on one side thereof across the outer surfaces of said adjacent bottom panels of said blanks, with the adhesive surface in operative contact with said bottom panels;

(vi) placing one row of five cigarette packs above the inner surface of each said bottom panel of said blanks;

(vii) folding said blanks along the remaining unfolded fold lines to completely assemble said blanks to form two individual cartons enveloping said cigarette packs, each carton containing five cigarette packs, wherein the connected cartons form a dual carton when completed.

12. The method of claim 11 further including the step of providing said label with indicia encoded for automatic pricing of the dual cigarette carton, said indicia located on the side of said label which is free of adhesive, said label being positioned such that said indicia are rendered unreadable by automatic equipment when said cartons are separated.

13. The method of claim 12 wherein said indicia are bar code lines and said step of placing said label further includes positioning said label such that said bar code lines are substantially parallel to the adjacent abutting edges of the walls across which said label is positioned such that said indicia are rendered unreadable by automatic equipment when said label is torn upon separating said cartons for sale of the individual cartons.

14. The method of claim 13 further including the step of providing said label with a line of weakness, and positioning said line of weakness above and substantially parallel to the adjacent edges of the walls across which the label is positioned.

15. The method of claim 14 wherein said step of providing a line of weakness further includes providing a line of perforations.

16. The method of claim 12 further including the step of providing indicia encoded for automatic pricing of an individual carton, containing five cigarette packs, on the outer surface of each said front panel of said blanks.

17. The method of claim 11 further including the steps of:

passing said dual carton is first passed through a commercially available cigarette tax-stamping machine; and separating said dual carton into said individual cartons by severing said joining strip and said label and pulling said cartons apart from each other.

18. The method of claim 17 further including the step of providing said joining strip with a line of weakness to facilitate severing of said joining strip.

19. The method of claim 18 wherein said step of providing a line of weakness further includes providing a line of perforations.

20. The method of claim 17 further including the step of providing said label with a line of weakness to facilitate severing of said label.

21. The method of claim 20 wherein said step of providing a line of weakness further includes providing a line of perforations.

22. The method of claim 17 further including the step of providing each said blank with an extension panel extending from said top panel.

23. The method of claim 22 wherein said step of folding the blank along the remaining unfolded fold lines further includes the step of folding said top panel and said extension panel of each said blank above the tops of said cartons such that said top panels and extension panels are lapped over each other.

24. The method of claim 22 further including the step of folding each top panel of said cartons over its respective carton after said dual carton is passed through a standard cigarette tax stamping machine.

25. The method of claim 24 wherein said step of folding each top panel of said cartons further includes the step of folding each said extension panel to be substantially parallel to said interior front walls of said dual carton.

* * * * *